US007911402B2

(12) United States Patent
Rowson et al.

(10) Patent No.: US 7,911,402 B2
(45) Date of Patent: Mar. 22, 2011

(54) ANTENNA AND METHOD FOR STEERING ANTENNA BEAM DIRECTION

(75) Inventors: Sebastian Rowson, San Diego, CA (US); Laurent Desclos, San Diego, CA (US); Jeffrey Shamblin, San Marcos, CA (US)

(73) Assignee: Ethertronics, Inc., San Diego, CA (US)

( * ) Notice: Subject to any disclaimer, the term of this patent is extended or adjusted under 35 U.S.C. 154(b) by 296 days.

(21) Appl. No.: 12/043,090

(22) Filed: Mar. 5, 2008

(65) Prior Publication Data

US 2009/0224991 A1 Sep. 10, 2009

(51) Int. Cl.
*H01Q 9/00* (2006.01)

(52) U.S. Cl. ..... 343/745; 343/700 MS; 343/795; 343/815

(58) Field of Classification Search ..... 343/745, 343/700 MS, 795, 815
See application file for complete search history.

(56) References Cited

U.S. PATENT DOCUMENTS

| | | | | |
|---|---|---|---|---|
| 3,971,031 | A * | 7/1976 | Burke | 343/744 |
| 5,235,343 | A * | 8/1993 | Audren et al. | 343/816 |
| 5,568,155 | A * | 10/1996 | Tsunekawa et al. | 343/700 MS |
| 5,598,169 | A * | 1/1997 | Drabeck et al. | 343/701 |
| 5,874,919 | A * | 2/1999 | Rawnick et al. | 343/700 MS |
| 6,326,921 | B1 * | 12/2001 | Egorov et al. | 343/700 MS |
| 6,765,536 | B2 | 7/2004 | Phillips et al. | |
| 7,068,234 | B2 * | 6/2006 | Sievenpiper | 343/745 |
| 2004/0027286 | A1 | 2/2004 | Poilasne et al. | |
| 2004/0227667 | A1 | 11/2004 | Sievenpiper | |
| 2005/0192727 | A1 | 9/2005 | Shostak | |
| 2005/0275596 | A1 | 12/2005 | Harano | |
| 2005/0285541 | A1 | 12/2005 | Lechevalier | |
| 2006/0220966 | A1 | 10/2006 | Sarychev et al. | |
| 2007/0069958 | A1 | 3/2007 | Ozkar | |
| 2007/0176824 | A1 | 8/2007 | Stumbo | |
| 2008/0001829 | A1 | 1/2008 | Rahola et al. | |

* cited by examiner

*Primary Examiner* — Tho G Phan
(74) *Attorney, Agent, or Firm* — Coastal Patent, LLC; Joshua S. Schoonover

(57) ABSTRACT

An antenna comprising an IMD element, and one or more parasitic and active tuning elements is disclosed. The IMD element, when used in combination with the active tuning and parasitic elements, allows antenna operation at multiple resonant frequencies. In addition, the direction of antenna radiation pattern may be arbitrarily rotated in accordance with the parasitic and active tuning elements.

41 Claims, 13 Drawing Sheets

ANTENNA AND METHOD FOR STEERING ANTENNA BEAM DIRECTION

Co-pending U.S. patent application Ser. No. 11/847,207, filed Aug. 20, 2007, entitled "Antenna With Active Elements," and co-pending U.S. patent application Ser. No. 11/840,617, filed Aug. 17, 2007, entitled "Antenna with Near Field Deflector," each of which is assigned to the assignee of this application, are incorporated herein by reference in their entirety for all purposes.

FIELD OF INVENTION

The present invention relates generally to the field of wireless communication. In particular, the present invention relates to antennas and methods for controlling radiation direction and resonant frequency for use within such wireless communication.

BACKGROUND OF THE INVENTION

As new generations of handsets and other wireless communication devices become smaller and embedded with more and more applications, new antenna designs are required to address inherent limitations of these devices and to enable new capabilities. With classical antenna structures, a certain physical volume is required to produce a resonant antenna structure at a particular frequency and with a particular bandwidth. In multi-band applications, more than one such resonant antenna structure may be required. But effective implementation of such complex antenna arrays may be prohibitive due to size constraints associated with mobile devices.

SUMMARY OF THE INVENTION

In one aspect of the present invention, an antenna comprises an isolated main antenna element, a first parasitic element and a first active tuning element associated with said parasitic element, wherein the parasitic element and the active element are positioned to one side of the main antenna element. In one embodiment, the active tuning element is adapted to provide a split resonant frequency characteristic associated with the antenna. The tuning element may be adapted to rotate the radiation pattern associated with the antenna. This rotation may be effected by controlling the current flow through the parasitic element. In one embodiment, the parasitic element is positioned on a substrate. This configuration may become particularly important in applications where space is the critical constraint. In one embodiment, the parasitic element is positioned at a pre-determined angle with respect to the main antenna element. For example, the parasitic element may be positioned parallel to the main antenna element, or it may be positioned perpendicular to the main antenna element. The parasitic element may further comprise multiple parasitic sections.

In one embodiment of the present invention, the main antenna element comprises an isolated magnetic resonance (IMD). In another embodiment of present invention, the active tuning elements comprise at least one of the following: voltage controlled tunable capacitors, voltage controlled tunable phase shifters, FET's, and switches.

In one embodiment of the present invention, the antenna further comprises one or more additional parasitic elements, and one or more active tuning elements associated with those additional parasitic elements. The additional parasitic elements may be located to one side of said main antenna element. They may further be positioned at predetermined angles with respect to the first parasitic element.

In one embodiment of the present invention, the antenna includes a first parasitic element and a first active tuning element associated with the parasitic element, wherein the parasitic element and the active element are positioned to one side of the main antenna element, a second parasitic element and a second active tuning element associated with the second parasitic element. The second parasitic element and the second active tuning element are positioned below the main antenna element. In one embodiment, the second parasitic and active tuning elements are used to tune the frequency characteristic of the antenna, and in another embodiment, the first parasitic and active tuning elements are used to provide beam steering capability for the antenna.

In one embodiment of the present invention, the radiation pattern associated with the antenna is rotated in accordance with the first parasitic and active tuning elements. In some embodiments, such as applications where null-filling is desired, this rotation may be ninety degrees.

In another embodiment of the present invention, the antenna further includes a third active tuning element associated with the main antenna element. This third active tuning element is adapted to tune the frequency characteristics associated with the antenna.

In one embodiment of the present invention, the parasitic elements comprise multiple parasitic sections. In another embodiment, the antenna includes one or more additional parasitic and tuning elements, wherein the additional parasitic and tuning elements are located to one side of the main antenna element. The additional parasitic elements may be positioned at a predetermined angle with respect to the first parasitic element. For example, the additional parasitic element may be positioned in parallel or perpendicular to the first parasitic element.

Another aspect of the present invention relates to a method for forming an antenna with beam steering capabilities. The method comprises providing a main antenna element, and positioning one or more beam steering parasitic elements, coupled with one or more active tuning elements, to one side of the main antenna element. In another embodiment, a method for forming an antenna with combined beam steering and frequency tuning capabilities is disclosed. The method comprises providing a main antenna element, and positioning one or more beam steering parasitic elements, coupled with one or more active tuning elements, to one side of the main antenna element. The method further comprises positioning one or more frequency tuning parasitic elements, coupled with one of more active tuning elements, below the main antenna element.

Those skilled in the art will appreciate that various embodiments discussed above, or parts thereof, may be combined in a variety of ways to create further embodiments that are encompassed by the present invention.

BRIEF DESCRIPTION OF THE DRAWINGS

FIG. 1(*b*) illustrates an exemplary radiation pattern associated with the antenna of FIG. 1(*a*).

FIG. 1(*c*) illustrates an exemplary frequency characteristic associated with the antenna of FIG. 1(*a*).

FIG. 2(*b*) illustrates an exemplary frequency characteristic associated with the antenna of FIG. 2(*a*).

FIG. 3(*b*) illustrates an exemplary radiation pattern associated with the antenna of FIG. 3(*a*).

FIG. 3(*c*) illustrates an embodiment of an antenna according to the present invention.

FIG. 3(*d*) illustrates an exemplary radiation pattern associated with the antenna of FIG. 3(*a*).

FIG. 3(*e*) illustrates an exemplary frequency characteristic associated with the antennas of FIG. 3(*a*) and FIG. 3(*c*).

FIG. 4(*b*) illustrates an exemplary frequency characteristic associated with the antenna of FIG. 4(*a*).

FIG. 5(*b*) illustrates an exemplary frequency characteristic associated with the antenna of FIG. 5(*a*).

FIG. 6(*b*) illustrates an exemplary radiation pattern associated with an IMD antenna.

FIG. 8(*b*) illustrates an exemplary frequency characteristic associated with the antenna of FIG. 7.

DETAILED DESCRIPTION OF THE PREFERRED EMBODIMENTS

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

One solution for designing more efficient antennas with multiple resonant frequencies is disclosed in co-pending U.S. patent application Ser. No. 11/847,207, where an Isolated Magnetic Dipole™ (IMD) is combined with a plurality of parasitic and active tuning elements that are positioned under the IMD. With the advent of a new generation of wireless devices and applications, however, additional capabilities such as beam switching, beam steering, space or polarization antenna diversity, impedance matching, frequency switching, mode switching, and the like, need to be incorporated using compact and efficient antenna structures. The present invention addresses the deficiencies of current antenna design in order to create more efficient antennas with beam steering and frequency tuning capabilities.

Figure 1B:
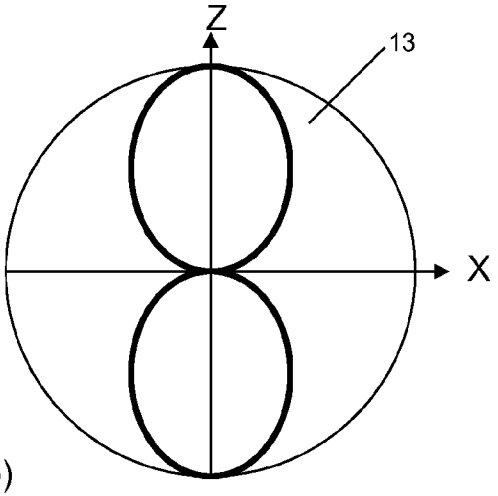
FIG. 1(b) (Prior Art)
FIG. 1(*a*) illustrates an exemplary isolated magnetic dipole (IMD) antenna.
Figure 1A:
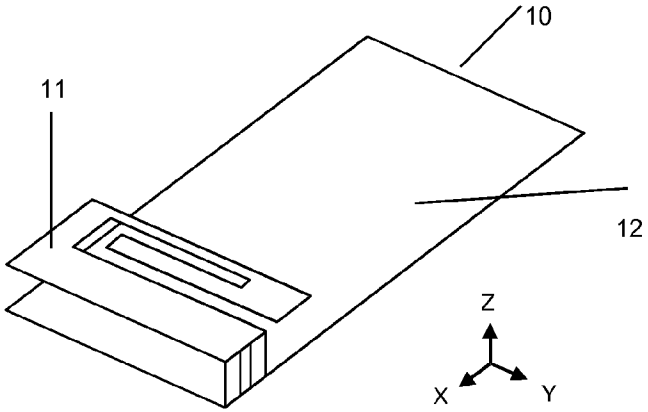
FIG. 1(a) (Prior Art)
Figure 1C:
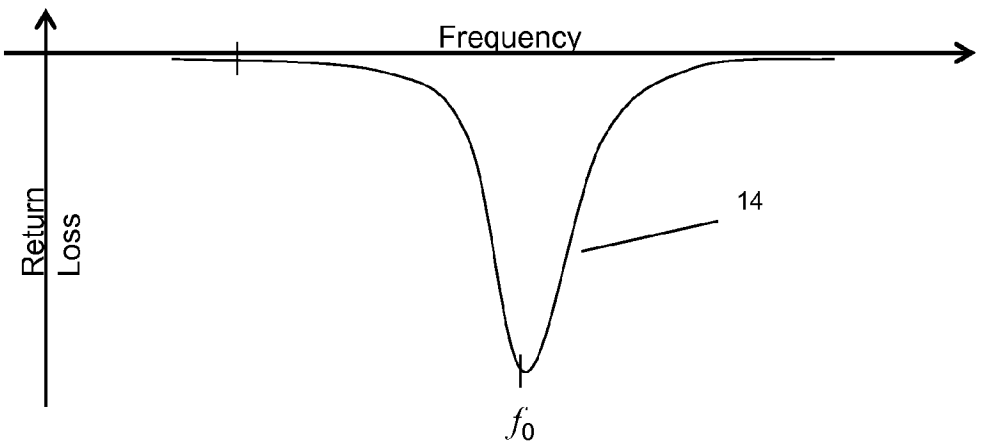
FIG. 1(c) (Prior Art)

Referring to FIG. 1(*a*), an antenna 10 is shown to include an isolated magnetic dipole (IMD) element 11 that is situated on a ground plane 12. The ground plane may be formed on a substrate such as a the printed circuit board (PCB) of a wireless device. For additional details on such antennas, reference may be made to U.S. patent application Ser. No. 11/675,557, titled ANTENNA CONFIGURED FOR LOW FREQUENCY APPLICATIONS, filed Feb. 15, 2007, and incorporated herein by reference in its entirety for all purposes. FIG. 1(*b*) illustrates an exemplary radiation pattern 13 associated with the antenna system of FIG. 1(*a*). The main lobes of the radiation pattern, as depicted in FIG. 1(*b*), are in the z direction. FIG. 1(*c*) illustrates the return loss as a function of frequency (hereinafter referred to as "frequency characteristic" 14) for the antenna of FIG. 1(*a*) with a resonant frequency, $f_0$. Further details regarding the operation and characteristics of such an antenna system may be found, for example, in the commonly owned U.S. patent application Ser. No. 11/675,557.

Figure 2A:
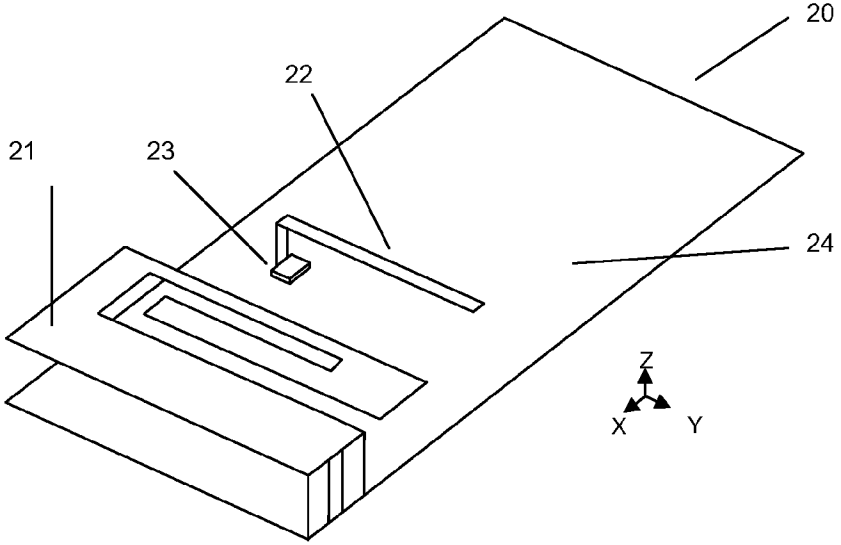
FIG. 2(*a*) illustrates an embodiment of an antenna according to the present invention.
Figure 2B:
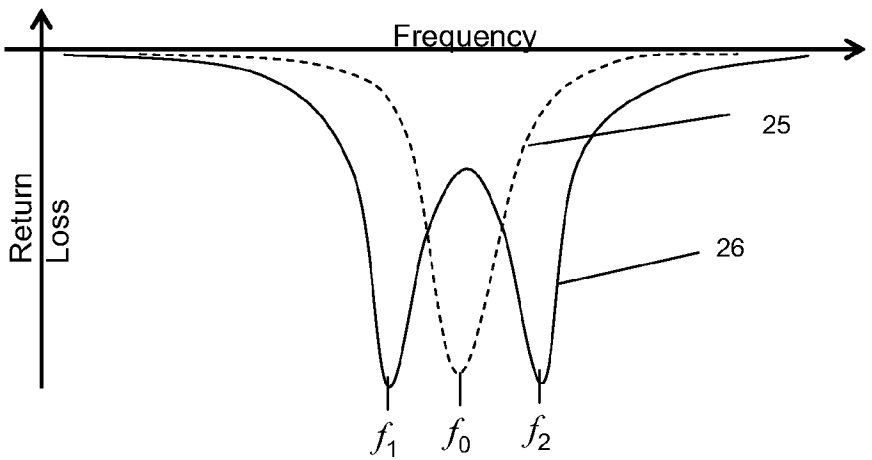
Figure 3C:
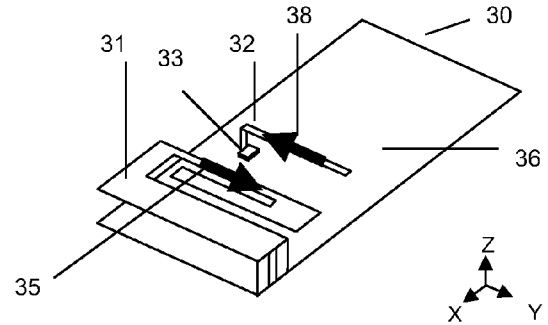
FIG. 3(*a*) illustrates an embodiment of an antenna according to the present invention.
Figure 3D:
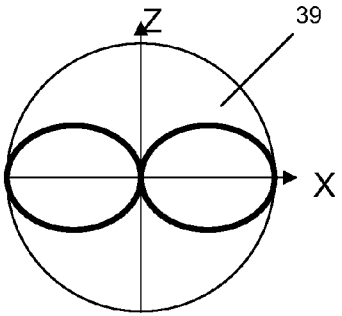
Figure 3A:
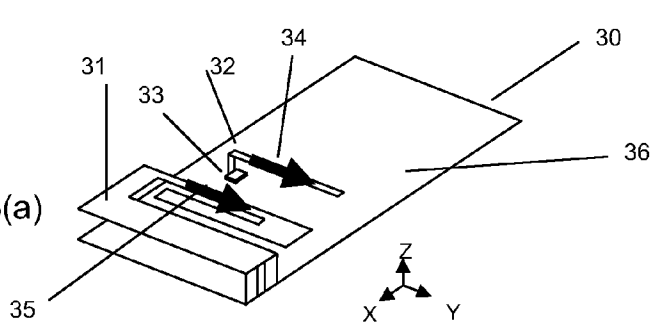
Figure 3B:
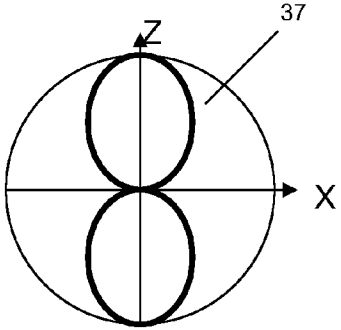
Figure 3E:
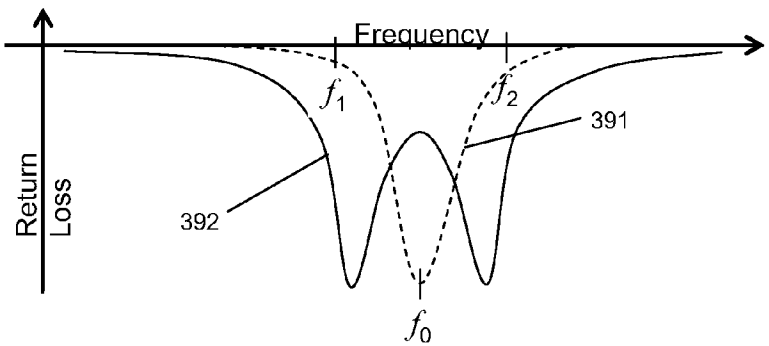

FIG. 2(*a*) illustrates, an antenna 20 in accordance with an embodiment of the present invention. The antenna 20, similar to that of FIG. 1(*a*), includes a main IMD element 21 that is situated on a ground plane 24. In the embodiment illustrated in FIG. 2(*a*), the antenna 20 further comprises a parasitic element 22 and an active element 23 that are situated on a ground plane 24, located to the side of the main IMD element 21. In this embodiment, the active tuning element 23 is located on the parasitic element 22 or on a vertical connection thereof. The active tuning element 23 can, for example, be any one or more of voltage controlled tunable capacitors, voltage controlled tunable phase shifters, FET's, switches, MEMs device, transistor, or circuit capable of exhibiting ON-OFF and/or actively controllable conductive/inductive characteristics. It should be further noted that coupling of the various active control elements to different antenna and/or parasitic elements, referenced throughout this specification, may be accomplished in different ways. For example, active elements may be deposited generally within the feed area of the antenna and/or parasitic elements by electrically coupling one end of the active element to the feed line, and coupling the other end to the ground portion. An exemplary frequency characteristic associated with the antenna 20 of FIG. 2(*a*) is depicted in FIG. 2(*b*). In this example, the active control may comprise a two state switch that either electrically connects (shorts) or disconnects (opens) the parasitic element to ground. FIG. 2(*b*) shows the frequency characteristic for the open and short states in dashed and solid lines, respectfully. As evident from FIG. 2(*b*), the presence of the parasitic element 22, with the active element 23 acting as a two state switch, results in a dual resonance frequency response. As a result, the typical single resonant frequency behavior 25 of an IMD antenna obtained in the open state with resonant frequency, $f_0$ (shown with dashed lines), is transformed into a double resonant behavior 26 (shown with solid lines), with two peak frequencies $f_1$ and $f_2$. The design of the parasitic element 22 and its distance from the main antenna element 21 determine frequencies $f_1$ and $f_2$.

FIG. 3(*a*) and FIG. 3(*c*) further illustrate an antenna 30 in accordance with an embodiment of the present invention. Similar to FIG. 2(*a*), an main IMD element 31 is situated on a ground plane 36. A parasitic element 32 and an active device 33 are also located to one side of the IMD element 31. FIG. 3(*a*) further illustrates the direction of current flow 35 (shown as solid arrow) in the main IMD element 31, as well as the current flow direction 34 in the parasitic element 32 in the open state, while FIG. 3(*c*) illustrates the direction of current flow 35 in the short state. As illustrated by the arrows in FIGS. 3(*a*) and 3(*c*), the two resonances result from two different antenna modes. In FIG. 3(*a*), the antenna current 33 and the open parasitic element current 34 are in phase. In FIG. 3(*c*), the antenna current 33 and the shorted parasitic element current 38 are in opposite phases. It should be noted that in general the design of the parasitic element 32 and its distance from the main antenna element 31 determines the phase difference. FIG. 3(*b*) depicts a typical radiation pattern 37 associated with the antenna 30 when the parasitic element 32 is in open state, as illustrated in FIG. 3(*a*). In contrast, FIG. 3(*d*) illustrates an exemplary radiation pattern 39 associated with the antenna 30 when the parasitic element 32 is in short state, as illustrated in FIG. 3(*c*). Comparison of the two radiation patterns reveals a rotation of ninety degrees in the radiation direction between the two configurations due to the two different current distributions or electromagnetic modes created by switching (open/short) of the parasitic element 32. The design of the parasitic element and its distance from the main antenna element generally determines the orientation of the radiation pattern. In this exemplary embodiment, the radiation pattern obtained at frequency $f_1$, with the parasitic element 32 in short state, is the same as the radiation pattern obtained at frequency $f_0$, with the parasitic element 32 in open state or no parasitic element as illustrated in FIG. 1(*b*). FIG. 3(*e*) further illustrates the frequency characteristics associated with either antenna configurations of FIG. 3(*a*) (dashed) or FIG. 3(*c*) (solid), which illustrates a double resonant behavior 392, as also depicted earlier in FIG. 2(*b*). The original frequency characteristic 391 in the absence of parasitic element 32, or in the open state, is also illustrated in FIG. 3(*e*), using dashed lines, for comparison purposes. Thus, in the exemplary embodiment of FIGS. 3(*a*) and 3(*c*), the possibility of operations such as beam switching and/or null-filling may be effected by controlling the current flow direction in the parasitic element 32, with the aid of an active element 33.

Figure 4A:
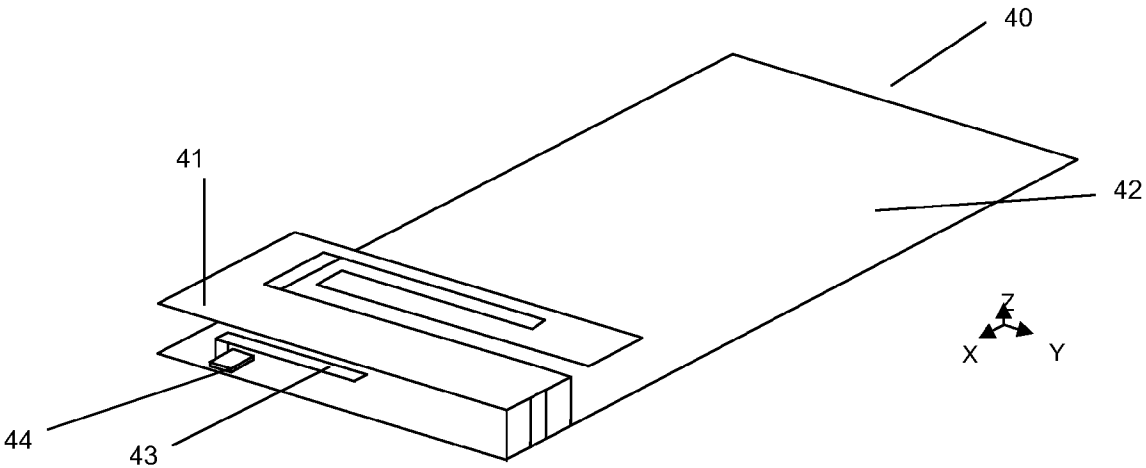
FIG. 4(*a*) illustrates an exemplary IMD antenna comprising a parasitic element and an active tuning element.
Figure 4B:
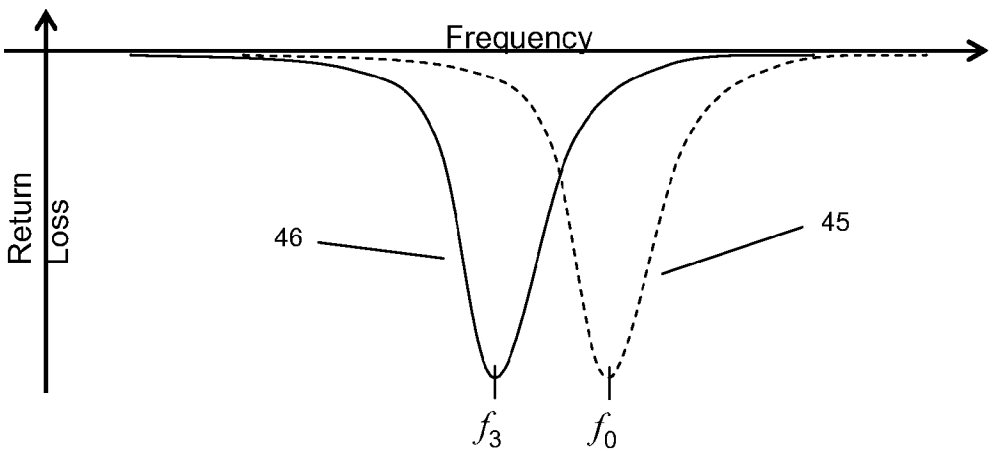

FIG. 4(*a*) illustrates another antenna configuration 40, which includes an main IMD element 41 that is situated on a ground plane 42. The antenna 40 further includes a tuning parasitic element 43 and an active tuning device 44, that are located on the ground plane 42, below or within the volume of the main IMD element 41. This antenna configuration, as described in the co-pending U.S. patent application Ser. No. 11/847,207, provides a frequency tuning capability for the antenna 40, wherein the antenna resonant frequency may be readily shifted along the frequency axis with the aid of the parasitic element 43 and the associated active tuning element 44. An exemplary frequency characteristic illustrating this shifting capability is shown in FIG. 4(*b*), where the original frequency characteristic 45, with resonant frequency, $f_0$, is moved to the left, resulting in a new frequency characteristic 46, with resonant frequency, $f_3$. While the exemplary frequency characteristic of FIG. 4(*b*) illustrates a shift to a lower frequency $f_3$, it is understood that shifting to frequencies higher than $f_0$ may be similarly accomplished.

Figure 5A:
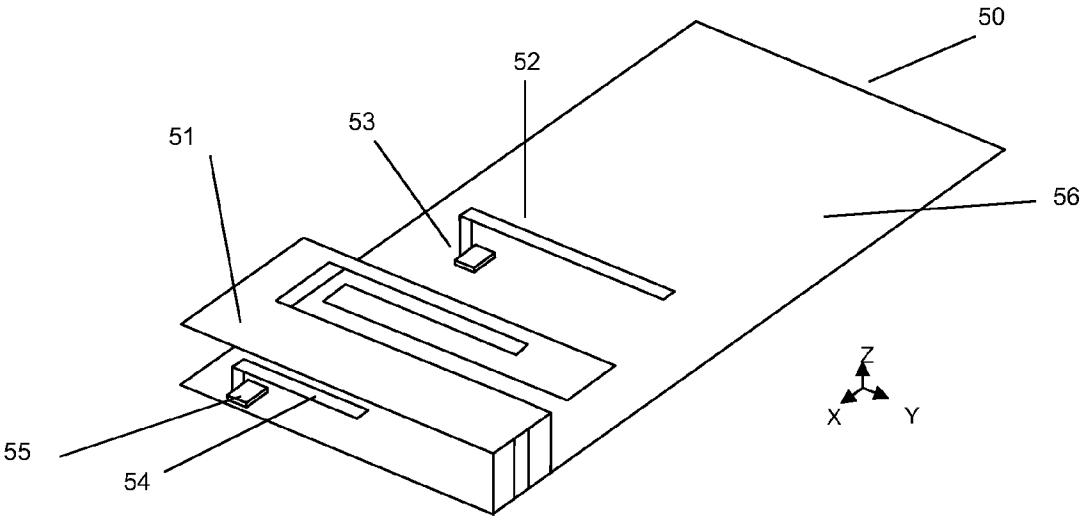
FIG. 5(*a*) illustrates an embodiment of an antenna according to the present invention.
Figure 5B:
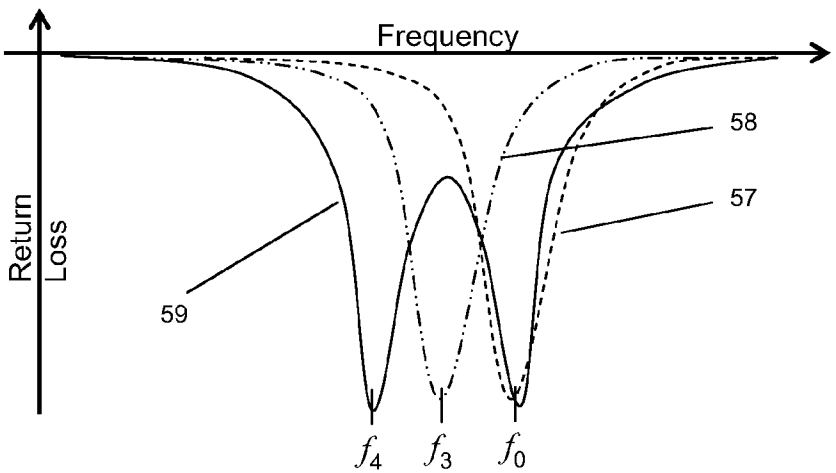
Figure 6B:
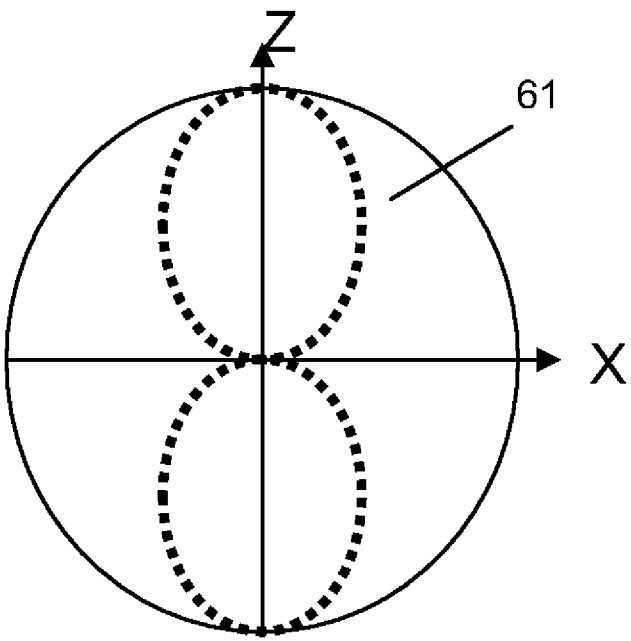
FIG. 6(*a*) illustrates an exemplary radiation pattern of an antenna according to the present invention.
Figure 6A:
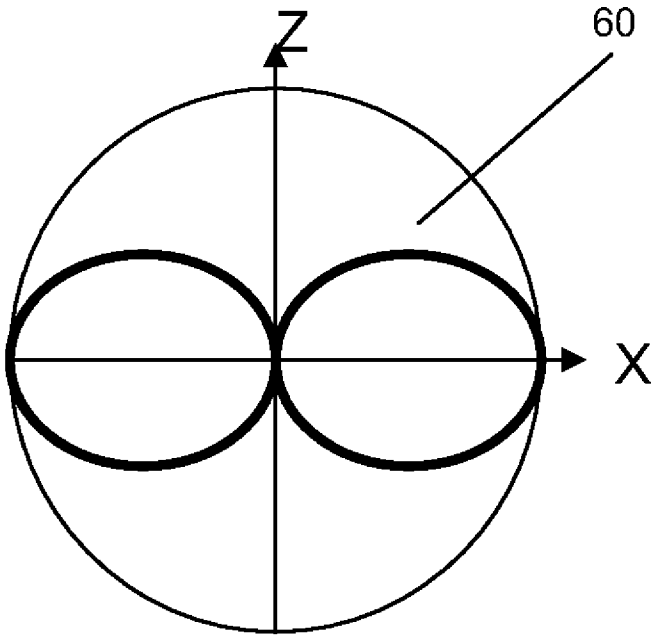

FIG. 5(*a*) illustrates another embodiment of the present invention, where an antenna 50 is comprised of an main IMD element 51, which is situated on a ground plane 56, a first parasitic element 52 that is coupled with an active element 53, and a second parasitic tuning element 54 that is coupled with a second active element 55. In this exemplary embodiment, the active elements 53 and 55 may comprise two state switches that either electrically connect (short) or disconnect (open) the parasitic elements to the ground. In combining the antenna elements of FIG. 2(*a*) with that of FIG. 4(*a*), the antenna 50 can advantageously provide the frequency splitting and beam steering capabilities of the former with frequency shifting capability of the latter. FIG. 5(*b*) illustrates the frequency characteristic 59 associated with the exemplary embodiment of antenna 50 shown in FIG. 5(*a*) in three different states. The first state is illustrated as frequency characteristic 57 of a simple IMD, obtained when both parasitic elements 52 and 54 are open, leading to a resonant frequency $f_0$. The second state is illustrate as frequency shifted characteristic 58 associated with antenna 40 of FIG. 4(*a*), obtained when parasitic element 54 is shorted to ground through switch 55. The third state is illustrated as a double resonant frequency characteristic 59 with resonant frequencies $f_4$ and $f_0$, obtained when both parasitic elements 52 and 54 are shorted to ground through switches 53 and 55. This combination enables two different modes of operation, as illustrated earlier in FIGS. 3(*a*)-3(*e*), but with a common frequency, $f_0$. As such, operations such as beam switching and/or null-filling may be readily effected using the exemplary configuration of FIG. 5. It has been determined that the null-filling technique in accordance with the present invention produces several dB signal improvement in the direction of the null. FIG. 6(*a*) illustrates the radiation pattern at frequency $f_0$ associated with the antenna 50 of FIG. 5(*a*) in the third state (all short), which exhibits a ninety-degree shift in direction as compared to the radiation pattern 61 of the antenna 50 of FIG. 5(*a*) in the first state (all open) (shown in FIG. 6(*b*)). As previously discussed, such a shift in radiation pattern may be readily accomplished by controlling (e.g., switching) the antenna mode through the control of parasitic element 52, using the active element 53. By providing separate active tuning capabilities, the operation of the two different modes may be achieved at the same frequency.

Figure 7:
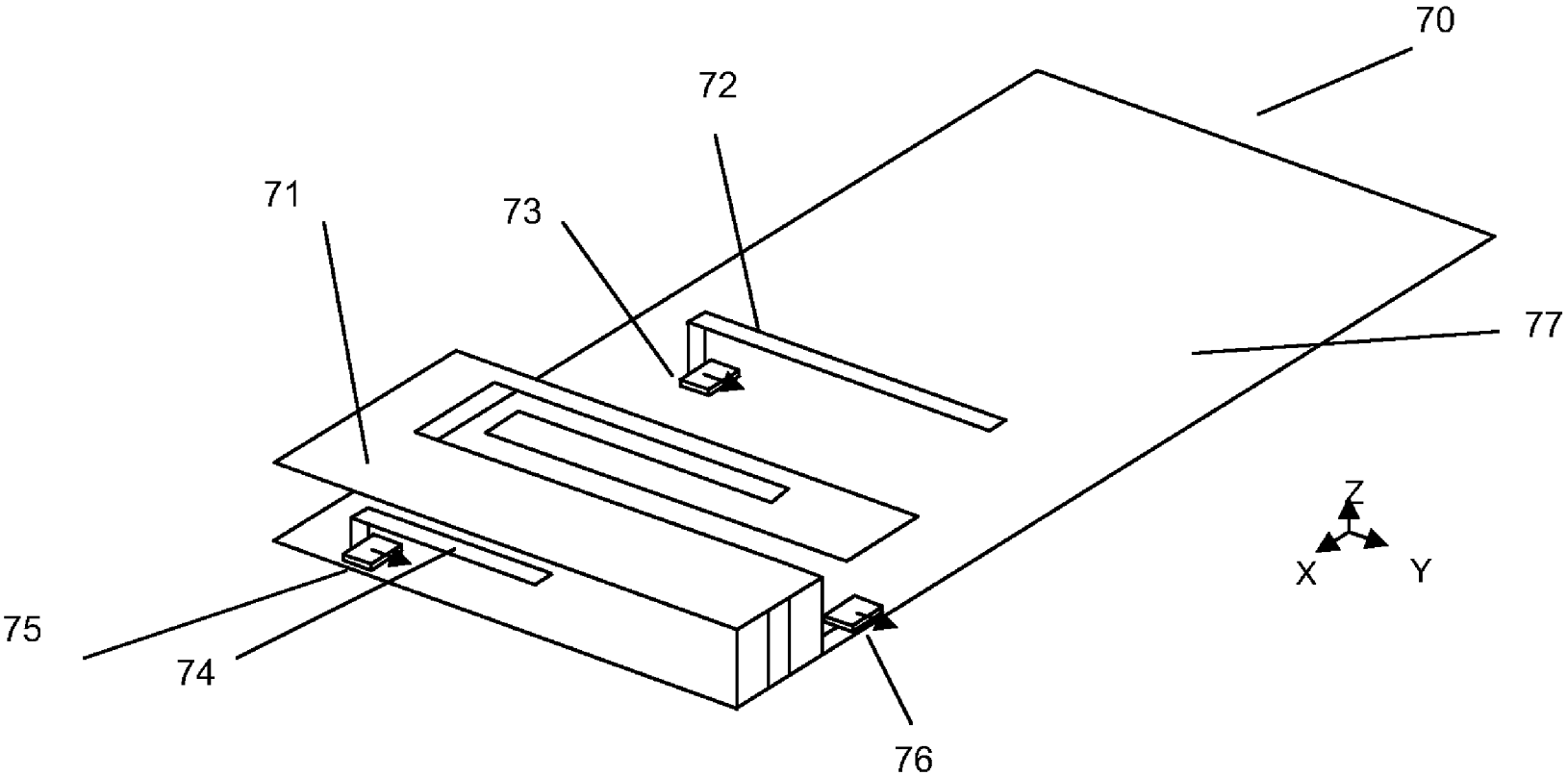
FIG. 7 illustrates an embodiment of an antenna according to the present invention.
Figure 8A:
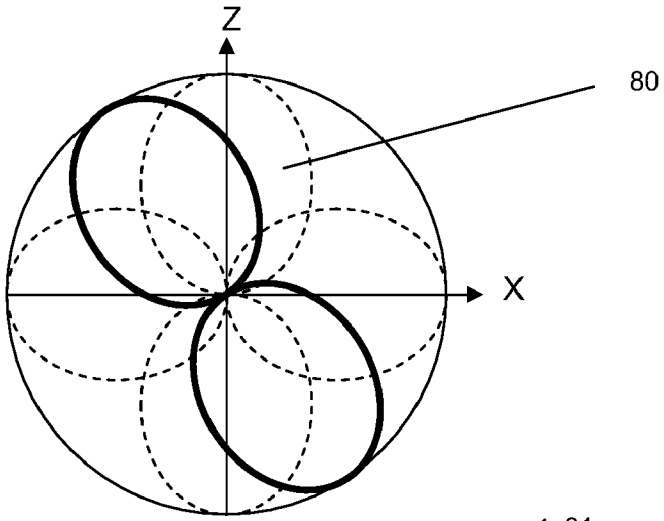
FIG. 8(*a*) illustrates an exemplary radiation pattern associated with the antenna of FIG. 7.
Figure 8B:
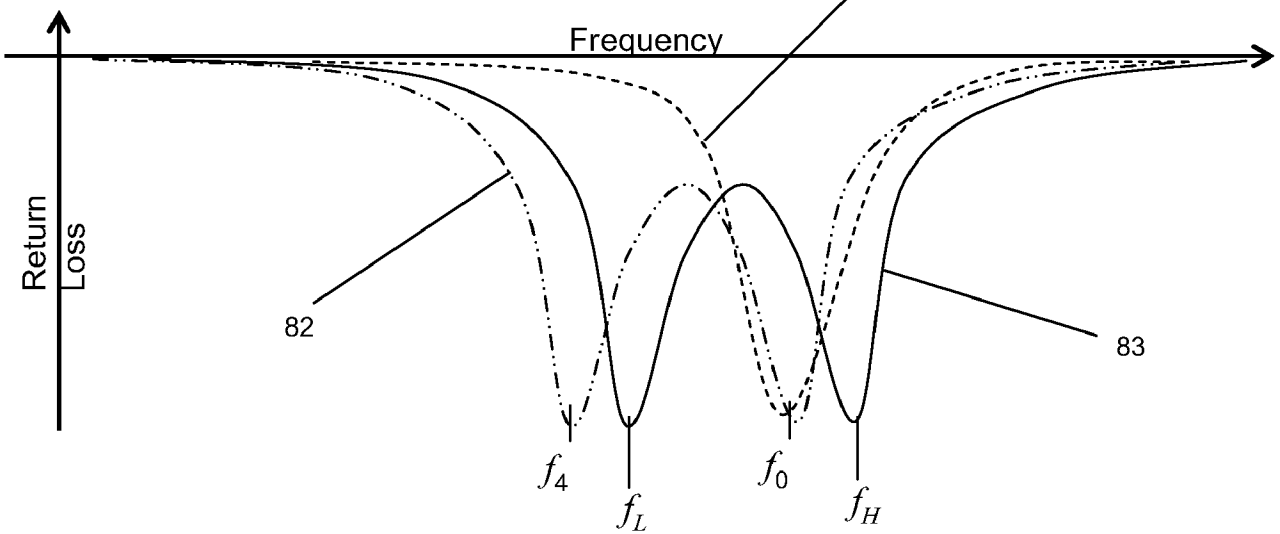

FIG. 7 illustrates yet another antenna 70 in accordance with an embodiment of the present invention. The antenna 70 comprises an IMD 71 that is situated on a ground plane 77, a first parasitic element 72 that is coupled with a first active tuning element 73, a second parasitic element 74 that is coupled with a second active tuning element 75, and a third active element 76 that is coupled with the feed of the main IMD element 71 to provide active matching. In this exemplary embodiment, the active elements 73 and 75 can, for example, be any one or more of voltage controlled tunable capacitors, voltage controlled tunable phase shifters, FET's, switches, MEMs device, transistor, or circuit capable of exhibiting ON-OFF and/or actively controllable conductive/inductive characteristics. FIG. 8(*a*) illustrates exemplary radiation patterns 80 that can be steered in different directions by utilizing the tuning capabilities of antenna 70. FIG. 8(*b*) further illustrates the effects of tuning capabilities of antenna 70 on the frequency characteristic plot 83. As these exemplary plots illustrate, the simple IMD frequency characteristic 81, which was previously transformed into a double resonant frequency characteristic 82, may now be selectively shifted across the frequency axis, as depicted by the solid double resonant frequency characteristic plot 83, with lower and upper resonant frequencies $f_L$ and $f_H$, respectively. The radiation patterns at frequencies $f_L$ and $f_H$ are represented in dashed lines in FIG. 8(*a*). By sweeping the active control elements 73 and 75, $f_L$ and $f_H$ can be adjusted in accordance with $(f_H-f_0)/(f_H-f_L)$, to any value between 0 and 1, therefore enabling all the intermediate radiation pattern. The return loss at $f_0$ may be further improved by adjusting the third active matching element 76.

Figure 9:
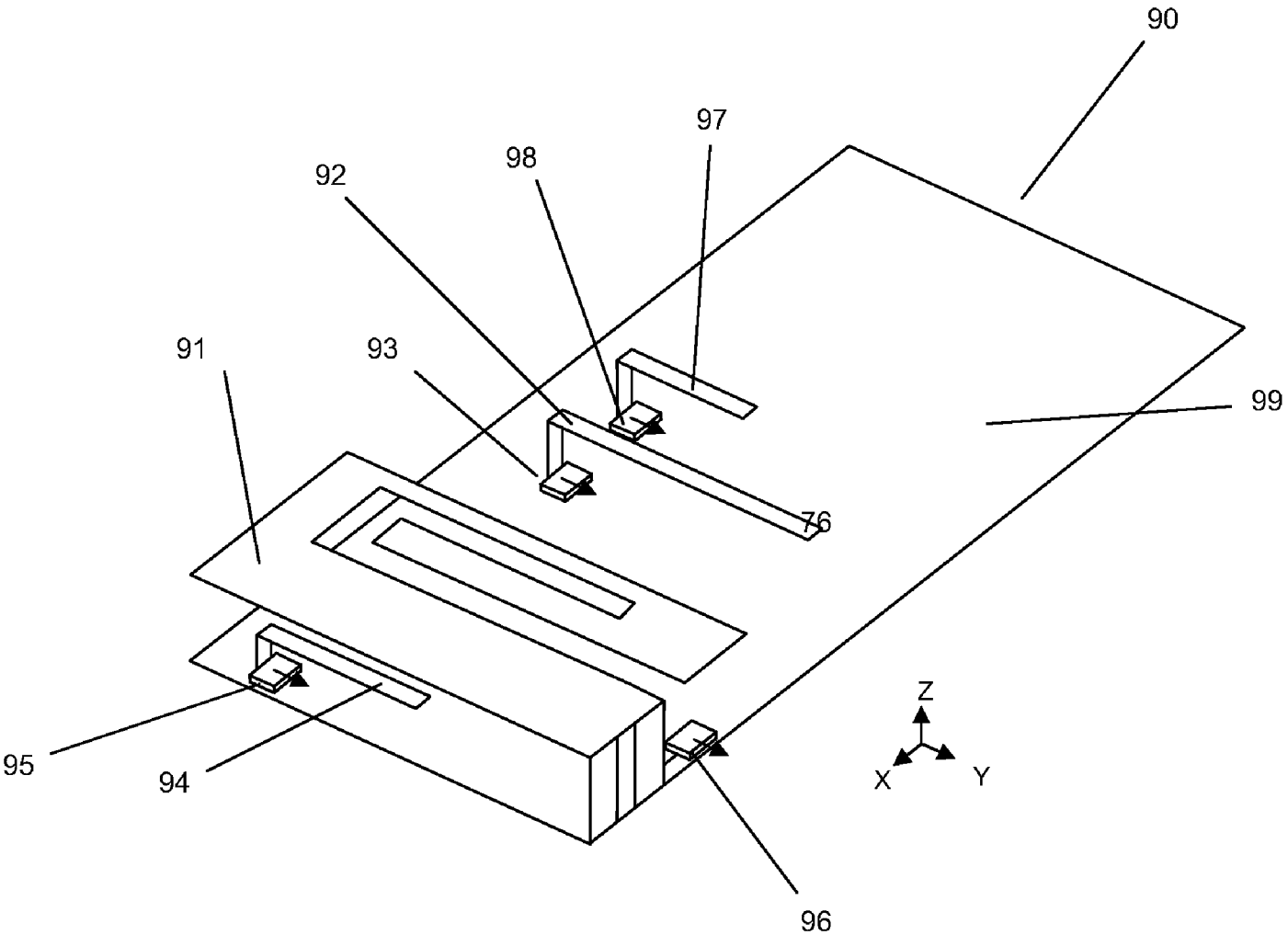
FIG. 9 illustrates another embodiment of an antenna according to the present invention.

FIGS. 9 through 13 illustrate embodiments of the present invention with different variations in the positioning, orientation, shape and number of parasitic and active tuning elements to facilitate beam switching, beam steering, null filling, and other beam control capabilities of the present invention. FIG. 9 illustrates an antenna 90 that includes an IMD 91, situated on a ground plane 99, a first parasitic element 92 that is coupled with a first active tuning element 93, a second parasitic element 94 that is coupled with a second active tuning element 95, a third active tuning element 96, and a third parasitic element 97 that is coupled with a corresponding active tuning element 98. In this configuration, the third parasitic element 97 and the corresponding active tuning element 98 provide a mechanism for effectuating beam steering or null filling at a different frequency. While FIG. 9 illustrates only two parasitic elements that are located to the side of the IMD 91, it is understood that additional parasitic elements (and associated active tuning elements) may be added to effectuate a desired level of beam control and/or frequency shaping.

Figure 10:
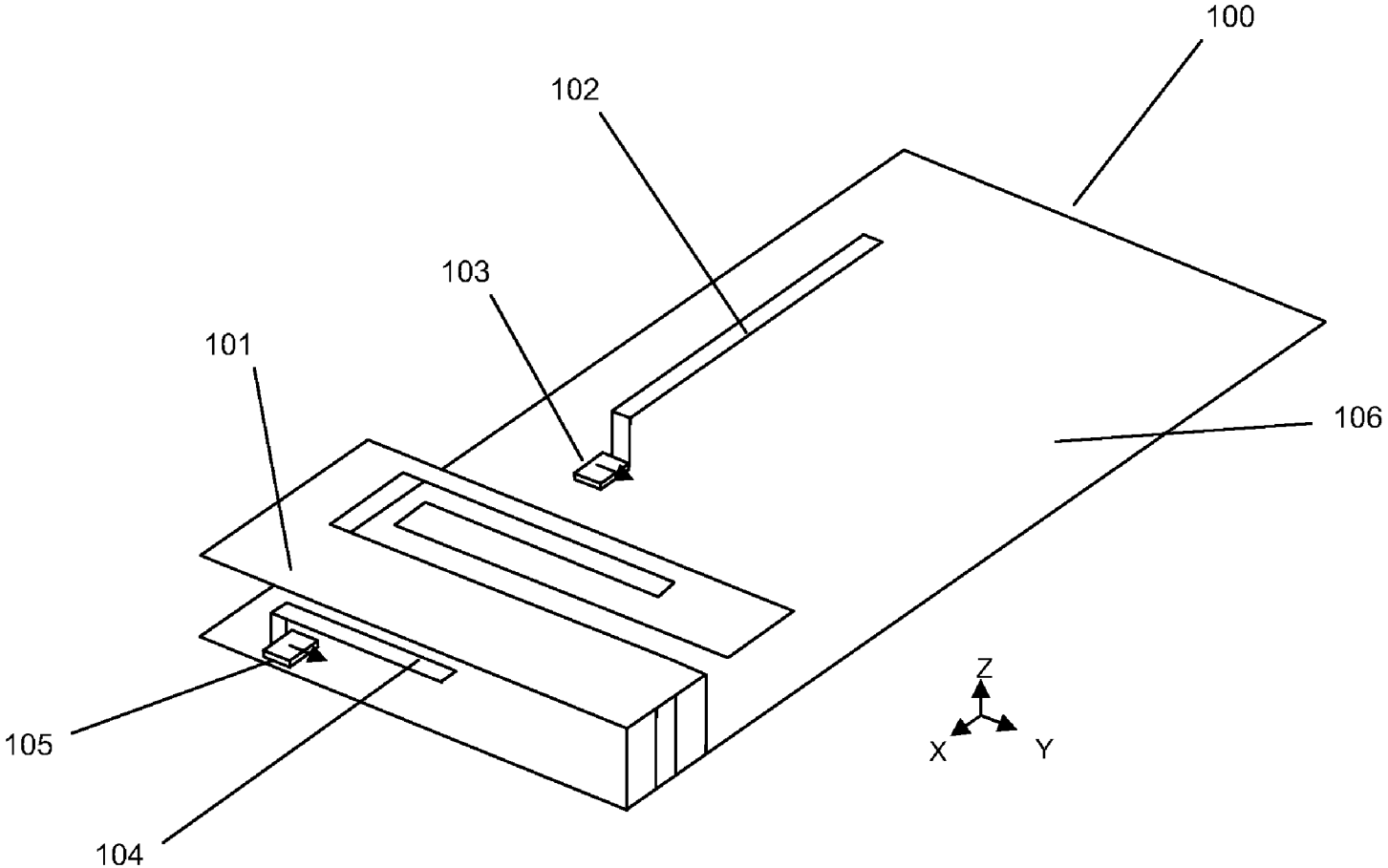
FIG. 10 illustrates another embodiment of an antenna according to the present invention.

FIG. 10 illustrates an antenna in accordance with an embodiment of the present invention that is similar to the antenna configuration in FIG. 5(*a*), except that the parasitic element 102 is rotated ninety degrees (as compared to the parasitic element 52 in FIG. 5(*a*)). The remaining antenna elements, specifically, the IMD 101, situated on a ground plane 106, the parasitic element 104 and the associated tuning element 105, remain in similar locations as their counterparts in FIG. 5(*a*). While FIG. 10 illustrates a single parasitic element orientation with respect to IMD 101, it is understood that orientation of the parasitic element may be readily adjusted to angles other than ninety degrees to effectuate the desired levels of beam control in other planes.

Figure 11:
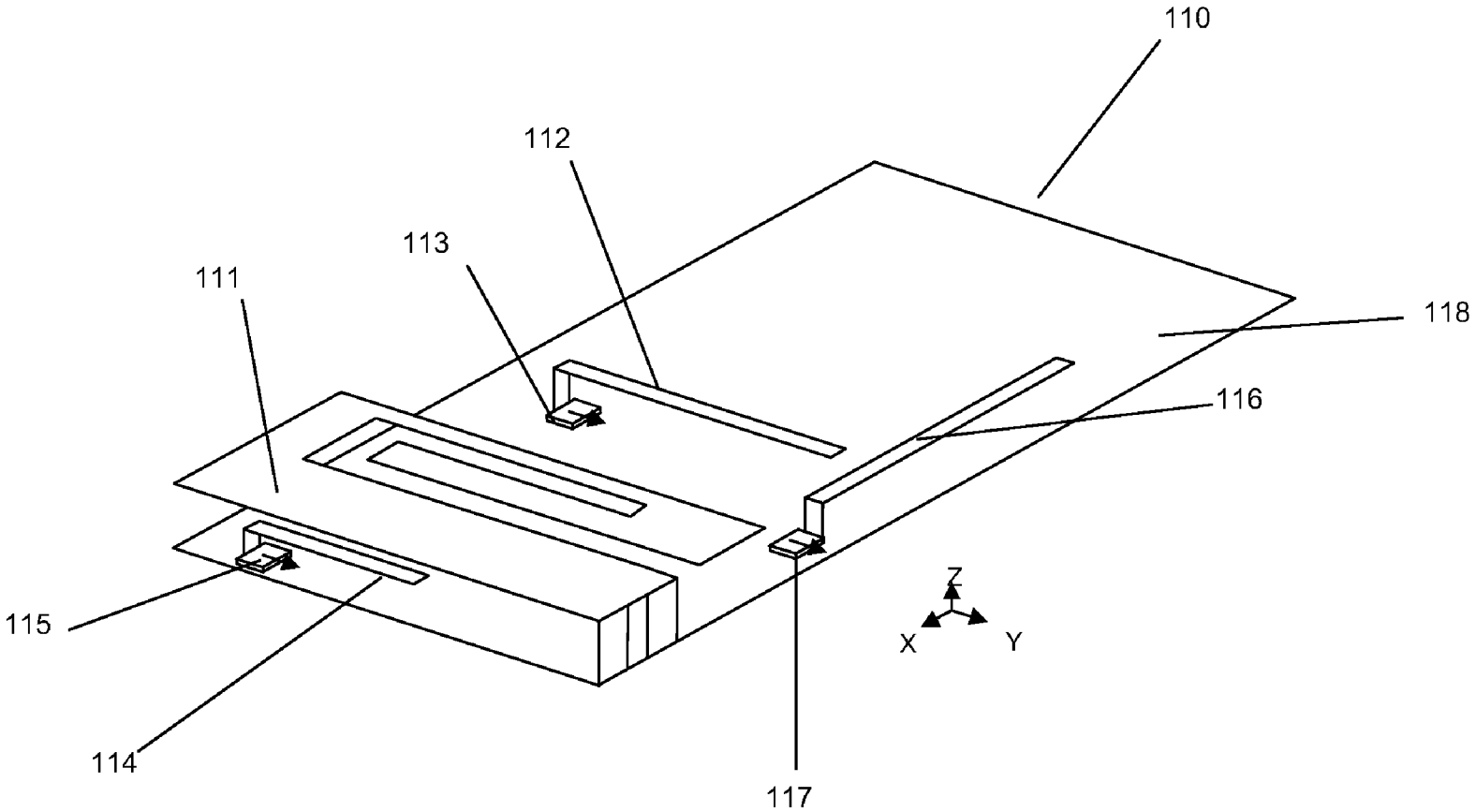
FIG. 11 illustrates another embodiment of an antenna according to the present invention.

FIG. 11 provides another exemplary antenna in accordance with an embodiment of the present invention that is similar to that of FIG. 10, except for the presence a third parasitic element 116 and the associated active tuning element 117. In the exemplary configuration of FIG. 11, the first parasitic element 112 and the third parasitic element 116 are at an angle of ninety degrees with respect to each other. The remaining antenna components, namely the main IMD element 111, the second parasitic element 114 and the associated active tuning device 115 are situated in similar locations as their counterparts in FIG. 5(*a*). This exemplary configuration illustrates that additional beam control capabilities may be obtained by the placement of multiple parasitic elements at specific orientations with respect to each other and/or the main IMD element enabling beam steering in any direction in space.

Figure 12:
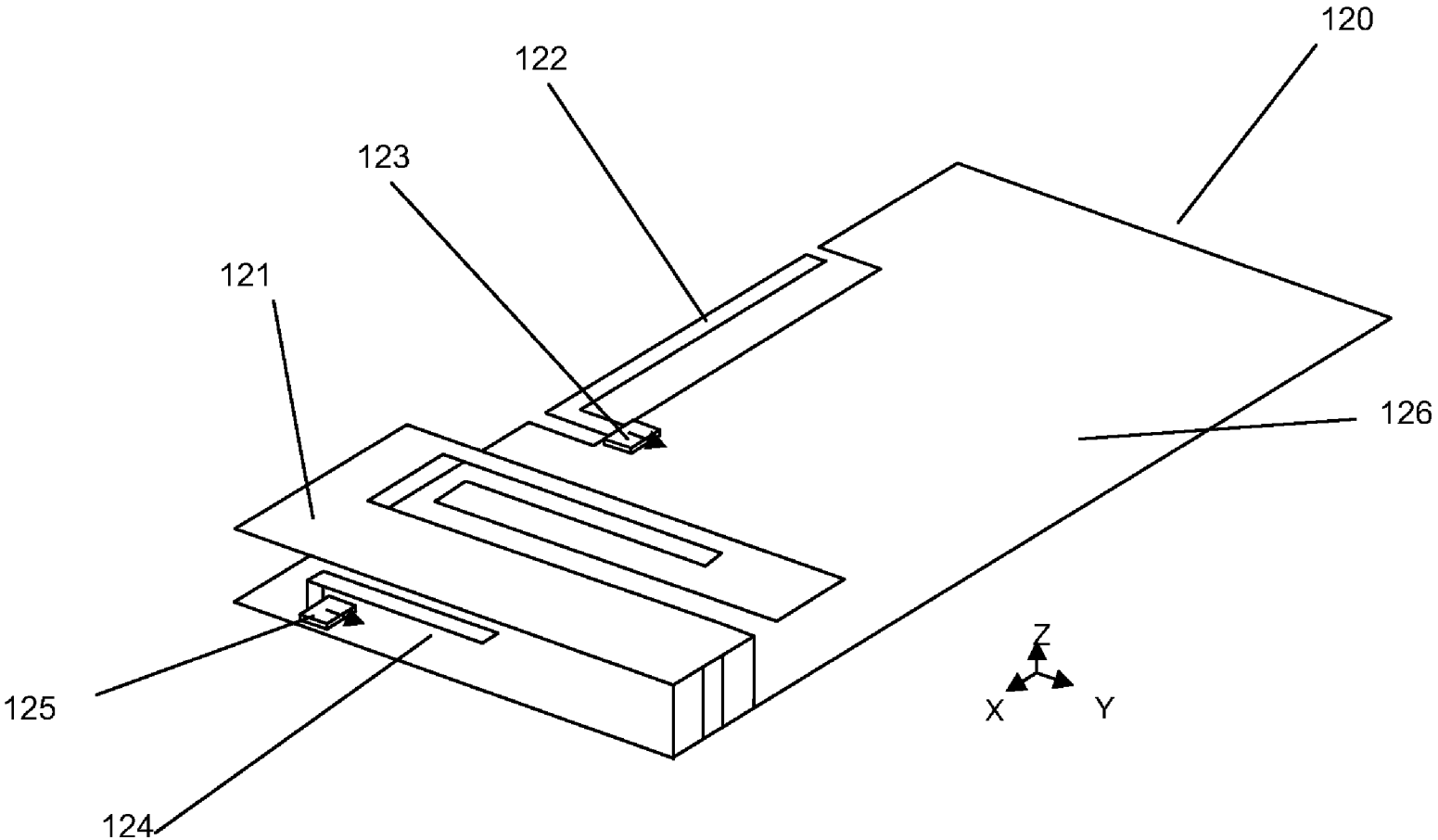
FIG. 12 illustrates another embodiment of an antenna according to the present invention.

FIG. 12 illustrates yet another antenna in accordance with an embodiment of the present invention. This exemplary embodiment is similar to that of FIG. 5(*a*), except for the placement of a first parasitic element 122 on the substrate of the antenna 120. For example, in applications where space is a critical constraint, the parasitic element 122 may be placed on the printed circuit board of the antenna. The remaining antenna elements, specifically, the IMD 121, situated on a ground plane 126, and the parasitic element 124 and the associated tuning element 125, remain in similar locations as their counterparts in FIG. 5(*a*).

Figure 13:
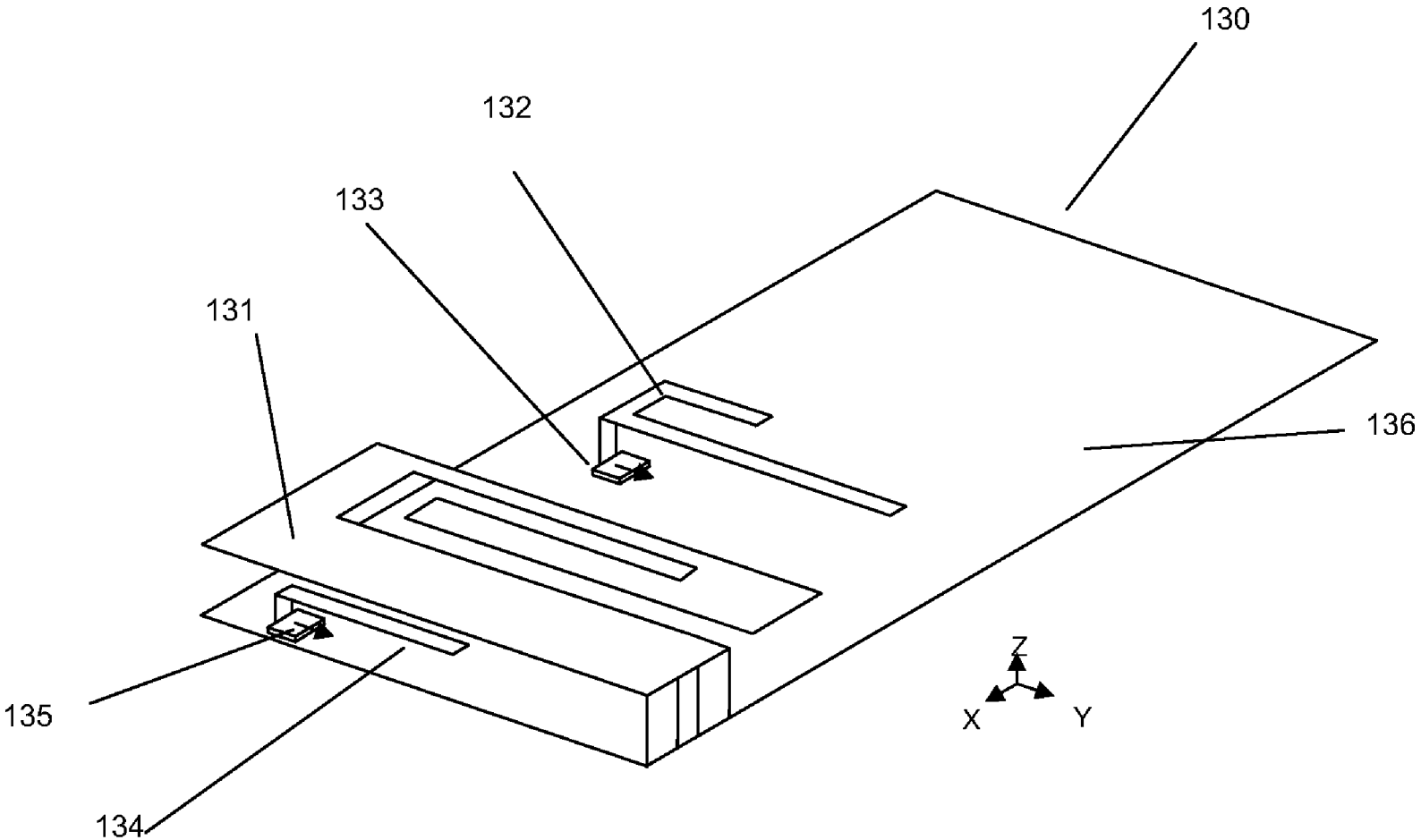
FIG. 13 illustrates another embodiment of an antenna according to the present invention.

FIG. 13 illustrates another antenna in accordance with an embodiment of the present invention. Antenna 130, in this configuration, comprises an IMD 131, situated on a ground plane 136, a first parasitic element 132 coupled with a first active tuning element 133, and a second parasitic element 134 that is coupled with a second active tuning element 135. The unique feature of antenna 130 is the presence of the first parasitic element 132 with multiple parasitic sections. Thus the parasitic element may be designed to comprise two or more elements in order to effectuate a desired level of beam control and/or frequency shaping.

As previously discussed, the various embodiments illustrated in FIGS. 9 through 13 only provide exemplary modifications to the antenna configuration of FIG. 5(*a*). Other modifications, including addition or elimination of parasitic and/or active tuning elements, or changes in orientation, shape, height, or position of such elements may be readily implemented to facilitate beam control and/or frequency shaping and are contemplated within the scope of the present invention.

While particular embodiments of the present invention have been disclosed, it is to be understood that various modifications and combinations are possible and are contemplated within the true spirit and scope of the appended claims. There is no intention, therefore, of limitations to the exact abstract and disclosure herein presented.

What is claimed is:

1. An antenna comprising;

A first antenna element positioned above a ground plane and forming an antenna volume therebetween;

a first parasitic element positioned outside of said antenna volume and adjacent to said first antenna; and a first active tuning element associated with said first parasitic element, said first active tuning element adapted to vary a current mode about said first parasitic element for actively steering a radiation pattern associated with said first antenna element.

2. The antenna of claim 1, wherein said first parasitic element is adapted to provide a split resonant frequency characteristic associated with said antenna.

3. The antenna of claim 1, wherein said first active tuning element is adapted to rotate the radiation pattern associated with said, antenna.

4. The antenna of claim 3, wherein the rotation of said radiation pattern is effected by controlling the current flow through said parasitic element.

5. The antenna of claim 3. wherein said radiation pattern is rotated by ninety degrees.

6. The antenna of claim 1, wherein said first parasitic element is positioned on a substrate.

7. The antenna of claim 1. wherein said first parasitic element is positioned at a pre-determined angle with respect to said first antenna element.

8. The antenna of claim 1, wherein said active tuning element comprises at least one of: a voltage controlled tunable capacitor, a voltage controlled tunable phase shifter, a FET, and a switch.

9. The antenna of claim 1, wherein said first parasitic element comprises multiple parasitic sections.

10. The antenna of claim 1, further comprising: one or more additional parasitic elements; and one or more active tuning elements associated with said additional parasitic elements, wherein said additional parasitic elements are positioned outside of said antenna volume and adjacent to said first antenna element.

11. The antenna of claim 10, wherein said additional parasitic elements are positioned at predetermined angles with respect to said first parasitic element.

12. The antenna of claim 1, wherein said first antenna element comprises an isolated magnetic dipole (IMD).

13. An antenna comprising:

a first antenna element positioned above a ground plane and forming an antenna volume therebetween;

a first parasitic element positioned outside of said antenna volume and adjacent to said first antenna;

a first active tuning element associated with said first parasitic element, said first active tuning element adapted to vary a current mode about said first parasitic element for actively steering a radiation pattern associated with said first antenna element;

a second parasitic element positioned within said antenna volume; and a second active tuning element associated with said second parasitic element; said second active tuning element adapted to vary a reactive coupling between said first antenna element and said second parasitic element for actively tuning a frequency characteristic associated with said first antenna element.

14. The antenna of claim 13, wherein said first parasitic element is adapted to provide a split resonant frequency characteristic associated with said antenna.

15. The antenna of claim 13, wherein the frequency characteristic associated with said antenna is tuned in accordance with said second parasitic element and said second active tuning element.

16. The antenna of claim 13, wherein said first parasitic element and said first active tuning element are adapted to provide beam steering capability. and said second parasitic element and said second active tuning element are adapted to provide frequency tuning capability associated with said antenna.

17. The antenna of claim 13, wherein the radiation pattern associated with said antenna is rotated in accordance with said first parasitic element and said first active tuning element.

18. The antenna of claim 17, wherein said radiation pattern is rotated ninety degrees.

19. The antenna of claim 13, further comprising a third active tuning element associated with said first antenna element, wherein said third active tuning element is adapted to tune the frequency characteristic associated with said antenna.

20. The antenna of claim 13, wherein said first parasitic element is positioned on a substrate.

21. The antenna of claim 13, wherein said first parasitic element is positioned at a pre-determined angle with respect to said first antenna element.

22. The antenna of claim 13, wherein the active tuning elements comprise at least one of voltage controlled tunable capacitors, voltage controlled tunable phase shifters, FET's, and switches.

23. The antenna of claim 13, wherein said first parasitic element comprises multiple parasitic sections.

24. The antenna of claim 13, further comprising: one or more additional parasitic elements; and one or more active tuning elements associated with said additional parasitic elements, wherein said additional parasitic elements are positioned outside of said antenna volume and adjacent to said first antenna clement.

25. The antenna of claim 24, wherein said additional parasitic elements are positioned at predetermined angles with respect to said first parasitic element.

26. The antenna of claim 13, wherein said first antenna element comprises an isolated magnetic dipole (IMD).

27. The antenna of claim 13, wherein said first parasitic element is not connected with said second parasitic element.

28. A method for forming an antenna with beam steering capabilities. comprising:

providing a first antenna element above a ground plane such that an antenna volume is defined therebetween;

positioning one or more beam steering parasitic elements outside of said antenna volume and adjacent to said first antenna element, wherein each of said beam steering parasitic elements are individually coupled with an active tuning element, wherein said active tuning element is adapted to vary a current mode about said beam steering parasitic element coupled therewith for actively steering a radiation pattern associated with said first antenna element; and optimizing at least one of a distance and angle between said one or more beam steering parasitic elements and said main antenna element.

29. The method of claim 28, wherein said beam steering parasitic elements are adapted to provide a split resonant frequency characteristic associated with said antenna.

30. The method of claim 28, wherein the radiation pattern associated with said antenna is rotated at arbitrary angles in accordance with said beam steering parasitic elements and said active tuning elements.

31. The method of claim 28. wherein the rotation of said radiation pattern is effected by controlling the current flow through said beam steering parasitic elements.

32. The method of claim 28, wherein said radiation pattern is rotated by ninety degrees.

33. The antenna of claim 28, wherein said first antenna element comprises an isolated magnetic dipole (IMD).

34. A method for forming an antenna with frequency tuning and beam steering capabilities, comprising:

providing a first antenna element disposed above a ground plane such that an antenna volume is defined therebetween;

positioning a beam steering parasitic element outside of said antenna volume and adjacent to said first antenna element, wherein said beam steering parasitic element is coupled with a first active tuning element, wherein said first active tuning element is adapted to vary a current mode about said beam steering parasitic element coupled therewith for actively steering a radiation pattern associated with said first antenna element;

optimizing at least one of a distance and angle between said beam steering parasitic elements and said first antenna element;

positioning a frequency tuning parasitic element within said antenna volume, wherein said frequency tuning parasitic element is coupled with a second active tuning element, wherein said second active tuning element is adapted to vary a coupling between said frequency shifting parasitic element and said first antenna element for actively tuning a frequency characteristic of said first antenna element.

35. The method of claim 34, wherein the radiation pattern associated with said antenna is rotated at arbitrary angles in accordance with said beam steering parasitic elements and said first active tuning elements.

36. The method of claim 35. wherein said radiation pattern is rotated ninety degrees.

37. The method of claim 34. wherein the frequency characteristic associated with said antenna comprises a split resonant frequency characteristic.

38. The method of claim 37, wherein said frequency characteristic is tuned in accordance with said frequency tuning parasitic elements and said second active tuning elements.

39. The method of claim 34. wherein an additional active tuning element is coupled with said first antenna element to provide further frequency tuning capabilities.

40. The method of claim 34, wherein said active tuning elements comprise at least one of: voltage controlled tunable capacitors, voltage controlled tunable phase shifters, FETs, and switches.

41. The method of claim 34, wherein said first antenna element comprises an isolated magnetic dipole (IMD).

* * * * *